US005130186A

United States Patent [19]

Pourtau et al.

[11] Patent Number: 5,130,186

[45] Date of Patent: Jul. 14, 1992

[54] MATERIAL FOR MAKING A FLOORING AND PROCESS FOR LAYING A FLOOR COVERING APPLYING SAME

[75] Inventors: Jean-Jacques Pourtau; Thierry E. Pourtau, both of Croissy-sur-Seine, France

[73] Assignee: Tomecanic, Aubergenville, France

[21] Appl. No.: 645,996

[22] Filed: Jan. 25, 1991

[30] Foreign Application Priority Data

Feb. 2, 1990 [FR] France ..... 90 01261

[51] Int. Cl.[5] ..... B32B 3/02; B32B 33/00

[52] U.S. Cl. ..... 428/95; 428/96; 428/141; 428/247; 428/250; 428/489; 428/97

[58] Field of Search ..... 428/291, 95, 282, 288, 428/290, 291, 247, 95, 96, 97; 106/273.1

[56] References Cited

U.S. PATENT DOCUMENTS 4,242,393 12/1980 Leupen ..... 428/95
4,702,950 10/1987 Slosbery et al. ..... 428/95
4,871,605 10/1989 Pagen et al. ..... 428/141

FOREIGN PATENT DOCUMENTS 1952114 4/1971 Fed. Rep. of Germany .
2829518 1/1980 Fed. Rep. of Germany .
2376744 8/1978 France .
2521621 8/1983 France .

*Primary Examiner*—Patrick J. Ryan
*Assistant Examiner*—Richard C. Weisberger
*Attorney, Agent, or Firm*—Skjerven, Morrill, MacPherson, Franklin & Friel

[57] ABSTRACT

This invention relates to a material for use in the production of a flooring in a building construction.

According to the invention, this material comprises an upper layer, an intermediate layer and a lower layer, while: a) each of the upper and lower layers is made of oxidized bitumen reinforced with first fibers and has a surface mass of between 500 and 1000 g/m$^2$; and b) the intermediate layer is made of an organic binding agent, such as a bitumen, and by second fibers, which are embedded in said binding agent and are in non-woven form.

One application is constituted by the laying of a tiling not subject to the development of cracks.

19 Claims, 2 Drawing Sheets

MATERIAL FOR MAKING A FLOORING AND PROCESS FOR LAYING A FLOOR COVERING APPLYING SAME

FIELD OF THE INVENTION

The present invention relates to a material for making a flooring and to a process for laying a floor covering applying same.

BACKGROUND OF THE INVENTION

The field of the invention is illustrated by the following example. Previously, floor tilings were bonded to their rigid support, such as a slab of reinforced concrete, by a cement or adhesive cement. Thus, they were subjected to variations in dimensions of said rigid support due to thermal expansions or contractions. Such floor tilings all result unsightly cracks. Moreover, the rigid bond is not such as to obtain satisfactory sound insulation between a floor tiling and its support.

In order to concomitantly eliminate the cracks and obtain adequate sound insulation, the idea has been formed, according to the invention, of interposing between the tiling, or more generally a floor covering, and the rigid support thereof, an insulating material adapted to avoid the transmission both of the variations in dimensions of the support and of sound waves to said floor covering.

It is therefore a first object of the invention to provide a material adapted to be used when making a floor in a building construction.

Certain materials intended for sound insulation are already known, but do not always have the desired efficiency. For example, with two-layer materials, namely an upper bituminous layer and the a lower layer of the glass wool type, it is observed that, in service, the glass wool is crushed, consequently producing bridges transmitting sound by the rough parts of the rigid support which come into contact with the upper bituminous layer. In addition, such a material does not allow satisfactory bonding of a tiling or the like, due to the absence of consistency of the lower layer.

It is precisely a first object of the invention to propose a building material which produces a flooring able to conserve its outer appearance for a long time and allow high-quality sound insulation to be obtained. In addition, this material must, of course, be relatively thin (maximum thickness of between 3 and 5 mm) in order to be effectively usable in the production of floorings, i.e., it must be notably thinner than certain multi-layer materials intended for heat-insulation, of which the thickness exceeds 10 mm and can reach up to 60 to 100 mm.

SUMMARY OF THE INVENTION

To that end, the material according to the invention comprises an upper layer, an intermediate layer and a lower layer, such that: a) each of the upper and lower layers is made of oxidized bitumen reinforce with first fibers and has a surface mass of between 500 and 1000 g/m$^2$ and b) the intermediate layer is made of an organic binding agent, such as a bitumen, and by second fibers, which are embedded in said binding agent and are in non-woven form.

The following advantageous arrangements are in addition preferably adopted:

the second fibers are glass fibers which each have a thickness between 50 and 150 $\mu$m;

the thickness of the intermediate layer is between 0.05 and 0.5 mm;

the surface mass of the intermediate layer is between 1 and 60 g/m$^2$;

the dimensional shrinking rate of each of the upper and lower layers, within a temperature range extending from −40° C. to +80° C., is at most equal to 0.001;

the assembly of the three layers constituting the material has a compressibility, at most, equal to 0.5 m, corresponding to a pressure of 0.4 bar;

the first fibers are glass fibers;

the surface mass of each of the upper and lower layers is close or equal to 700 g/m$^2$;

the thickness of each of the upper and lower layers is included between 0.5 and 1.5 mm;

the outer face of each of the upper and lower layers, opposite the face of the upper and lower layers which is adjacent the intermediate layer, is coated with a non-stick powder, such as sandstone powder, to avoid the adherence of said upper and lower layers to one another during possible storage thereof with superposition.

The invention also relates to a process for laying on a rigid support, such as a slab or reinforced concrete, a floor covering such as a tiling, employing a material according to any one of the definitions set forth above, the process comprising: a) laying the outer face of the lower layer of said material on the rigid support, and b) fixing said floor covering to the outer face of the upper layer of the material by means of an adhesive.

The following features are preferably adopted an adhesive mortar is selected as the adhesive mentioned in b);

an adhesive is interposed between the lower layer of the material and the support.

The principal advantage of the invention is to make available to builders a material which effectively eliminates the transmissions both of dimensional variations and of sound, between a rigid support and the floor covering that it supports.

In particular, it is possible to lay a tiling by using this material in accordance with the laying process described above.

BRIEF DESCRIPTION OF THE DRAWINGS

The invention will be more readily understood by reading the following description with reference to the accompanying drawings, in which.

DETAILED DESCRIPTION OF THE DRAWINGS

Figure 1:
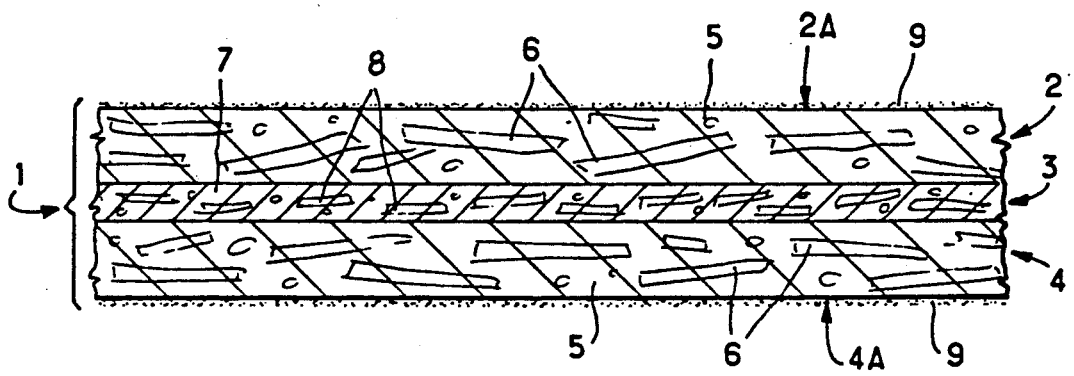
FIG. 1 is a section through a material according to the invention.

Referring now to the drawings, the material 1 shown in FIG. 1 comprises an upper layer 2, an intermediate layer 3 and a lower layer 4.

The upper and lower layers 2 and 4 respectively are generally similar, approximately of the same composition and of identical dimensions.

In the example shown, these two layers have effectively the same thickness and the same composition.

Each of the these upper and lower layers 2 and 4 has the following characteristics:

- made of oxidized bitumen 5 within which first fibers 6 are embedded, preferably and in the example described, constituted by glass fibers;
- the percentages by weight, which have been determined by experiment to yield the best results are: from 95 to 98% of oxidized bitumen and from 2 to 5% of fibers, particularly glass fibers;
- surface mass of each of the upper and lower layers between 500 and 1000 g/n$^2$, and preferably equal to 700 g/m$^2$;
- almost total absence of shrinkage between −40° C. and +80° C. (dimensional shrinkage at most equal to 0.001 in the temperature range mentioned);
- virtual incompressiblity of the material, such in compressibility related to the presence of the fibers which avoid a crushing of the various layers, the assembly of the three layers constituting this material having a compressibility at, most, equal to 0.5 mm, corresponding to a pressure of 0.4 bar;
- thickness of each of the upper and lower layers between 0.5 and 1.5 mm.

The intermediate layer 3 presents the following characteristics:

- made of an organic binding agent 7, such as a malleable bitumen, within which second fibers 8 are embedded in non-woven form;
- these second fibers are preferably glass fibers;
- thickness of the second fiber between 50 and 150 μm;
- thickness of the intermediate layer 3 between 0.05 and 0.5 mm;
- surface mass of the intermediate layer 3 between 1 and 60 g/m$^2$.

Although glass fibers are preferably adopted, it must be indicated that other types of fibers—carbon or even vegetable—may equally well be used.

It may be observed that a fine layer of powder 9, sandstone in the example described, but more generally a non-stick material, has bee dusted on the outer faces 2A and 4A of the upper and lower layers 2 and 4 respectively, and thus allows storage by stacking a plurality of sheets of materials 1 on one another door winding a long length of the same sheet on itself, thus avoiding any adherence of one sheet on the adjacent one. Furthermore, these fine layers of powder 9 have no influence on the ability to fix a sheet of material 1 when making a flooring, as will now be observed.

Figure 2:
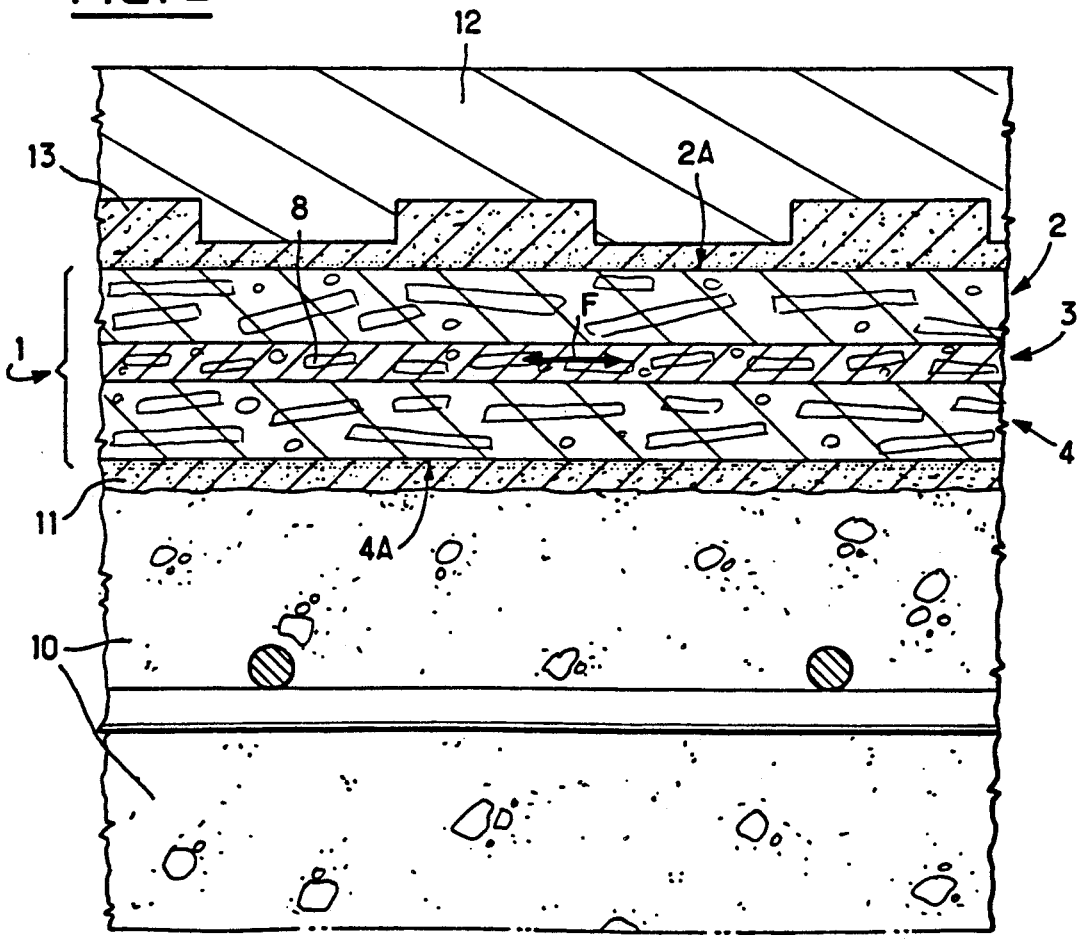
FIG. 2 is a section showing a tiling laid according to a first variant of a laying process according to the invention.

FIG. 2 shows a flooring constituted by a slab of reinforced concrete 10, on which the lower face 4A of a sheet of a material 1 has been fixed with the aid of a layer 11 of adhesive mortar, sandstone or like tiles 12 being placed on the upper face 2A of the sheet of material 1 and being fixed thereon by a layer 13, likewise of an adhesive mortar (only one tile 12 has been shown).

Figure 3:
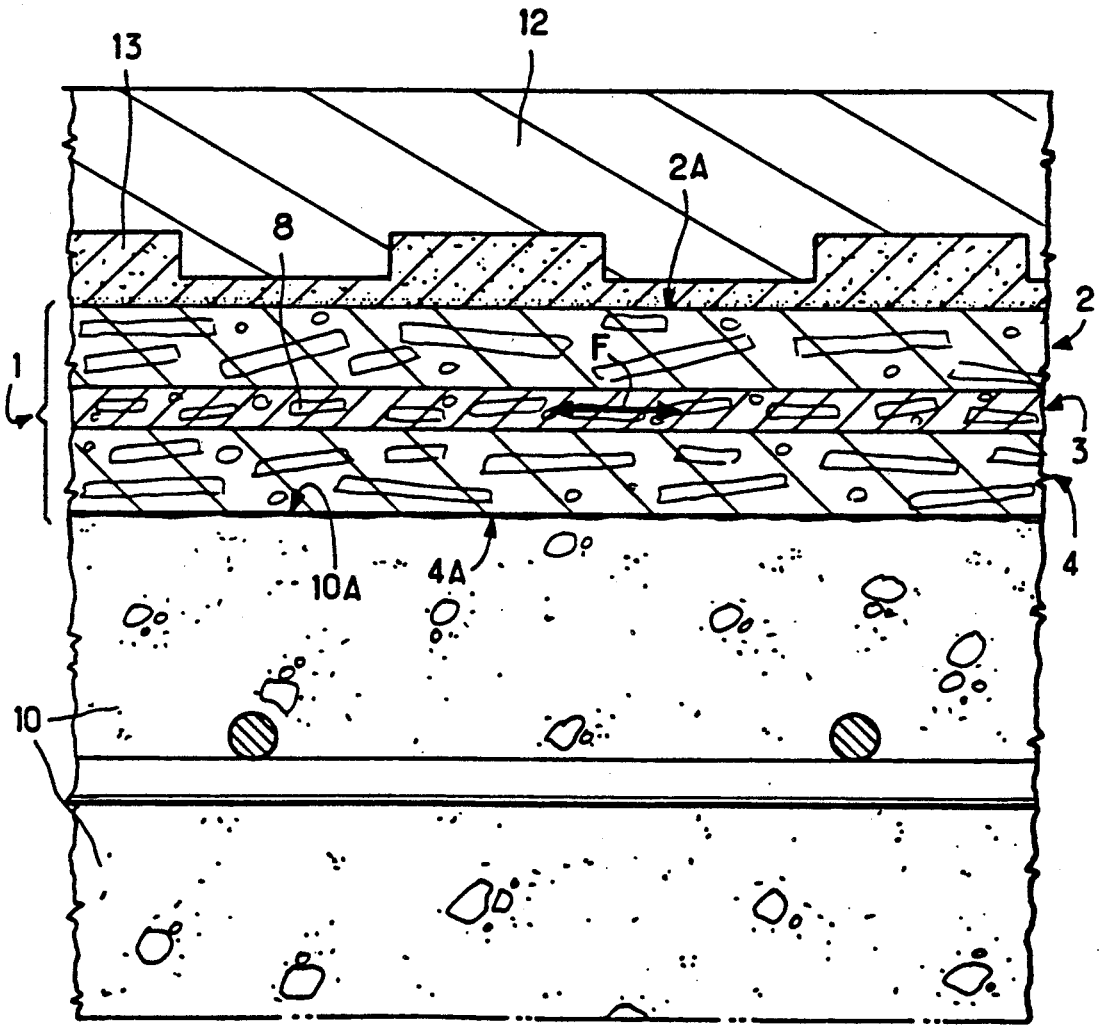
FIG. 3 is a section showing a tiling laid according to a second variant of a laying process according to the invention.

FIG. 3 shows the arrangement of FIG. 2, in which the layer 11 of adhesive mortar has not been provided, the lower face 4A of the sheet of material 1 being simply laid on the upper face 10A of the slabe 10.

In the embodiment of FIG. 2, the fine layer 9 of powder have been absorbed in the adhesive mortar of layers 11 and 13. In the embodiment of FIG. 3, the fine layer 9 of powder disposed on the outer face 4A of layer 4 has disappeared in the rough parts of faced 10A of the slab 10, with the result that such layers 9 of powder effectively do not hinder fixation of the sheet of material 1 to the slab 10 and to the tiles 12.

The advantages of the embodiments described will be demonstrated by setting forth the features of the structures shown in FIGS.

The material 1 constitutes a good insulating agent between the slab 10 and the tiles 12 as far as non-transmission of thermal expansions or shrinkages of the slab 10 to said tiles is concerned. In fact, the constitution of the relatively rigid incompressible upper and lower layers 2 and 4, and the intermediate layer 3, which is more malleable, though not subject to crushing because of the second fibers 8 that it contains, allows a certain relative slide of the upper layer 2 with respect to the lower layer 4 (arrow F), the direction of the slide being parallel to said layers, such that each of these two upper and lower layers remain unchanged and virtually exempt from thermal shrinkage.

Under these conditions, it will be understood that the possible variations in temperature slab 10, due to variations in temperature or movements of structural order, are note transmitted to the tiles 12 and cannot cause cracks therein.

In addition, the material 1 also has good characteristics of sound insulation. It already has the characteristic generally present in multi-layer material of opposing the propagation of sound waves. Moreover, the relative hardness of the lower layer 4 eliminates the risk of the rough parts of the upper face 10A of the slab 10 establishing a direct link between this slab and the upper layer 2 by piercing through the intermediate layer 3. In the embodiments shown, these rough parts are stopped by the lower layer 4, this advantage not being provided by a simple thin layer of glass wool, for example.

The invention is not limited to the embodiments described, but covers, on the contrary, all the variants that may be made thereto without departing from their scope or spirit.

In particular, the floor covering may be constituted by tiles 12 of a hard tiling (sandstone tiles), but may equally well be constituted by plastic materials (linoleum or the like) or even fitted carpeting.

What is claimed is:

1. Material for use in the production of a flooring comprising an upper layer, an intermediate layer and a lower layer, wherein both the upper layer and the lower layer are made of oxidized bitumen reinforced with first fibers and have a surface means between 500 and 1000g/m$^2$, and the intermediate layer is made of an organic binding agent and second fibers, said second fibers being embedded in said binding agent in non-woven form, and has a surface mass between 1 and 60 g/m$^2$.

2. The material of claim 1, wherein said second fibers are glass fibers which each have a thickness of between 50 and 150 μm.

3. The material of claim 1, wherein the thickness of the intermediate layer is included between 0.05 and 0.5 mm.

4. The material of claim 2, wherein the thickness of the intermediate layer is included between 0.05 and 0.5 mm.

5. The material of claim 1, wherein the dimensional shrinkage rate of each of said upper and lower layers, in a temperature range extending form −40° C. to +80° C., is at the most equal to 0.001.

6. The material of claim 1, wherein the assembly of the three layers constituting it has a compressibility at the most equal to 0.5 mm corresponding to a pressure of 0.4 bar.

7. The material of claim 2, wherein the assembly of the three layers constituting it has a compressibility at the most equal to 0.5 mm corresponding to a pressure of 0.4 bar.

8. The material of claim 3, wherein the assembly of the three layers constituting it has a compressibility at the most equal to 0.5 mm corresponding to a pressure of 0.4 bar.

9. The material of claim 4, wherein the assembly of the three layers constituting it has a compressibility at the most equal to 0.5 mm corresponding to a pressure of 0.4 bar.

10. The material of claim 1, wherein said first fibers are glass fibers.

11. The material of claim 2, wherein said first fibers are glass fibers.

12. The material of claim 3, wherein said first fibers are glass fibers.

13. The material of claim 4, wherein said first fibers are glass fibers.

14. The material of claim 1, wherein the surface mass of each of said upper and lower layers is close or equal to 70 $g/m^2$.

15. The material of claim 1, wherein the thickness of each of said upper and lower layers is included between 0.5 and 1.5 mm.

16. The material of claim 2, wherein the thickness of each of said upper and lower layers is included between 0.5 and 1.5 mm.

17. The material of claim 3, wherein the thickness of each of said upper and lower layers is included between 0.5 and 1.5 mm.

18. The material of claim 4, wherein the thickness of each of said upper and lower layers is included between 0.5 and 1.5 mm.

19. The material of claim 1, wherein said upper and lower layers each have an outer face, said outer face being opposite a face of said upper and lower layers which is adjacent the intermediate layer, said outer face being coated with a non-stick powder to avoid the adherence of said upper and lower layers on each other when superposed for storage.

* * * * *

UNITED STATES PATENT AND TRADEMARK OFFICE

CERTIFICATE OF CORRECTION

PATENT NO. : 5,130,186
DATED : 07/14/92
INVENTOR(S) : Jean-Jacques Pourtau
Thierry E. Pourtau

It is certified that error appears in the above-identified patent and that said Letters Patent is hereby corrected as shown below:

| | |
|---|---|
| Col. 1, line 18 | Delete "all result" and insert --develop--; |
| Col. 1, line 24 | Delete "," first occurrence and insert -- - --; |
| Col. 1, line 36 | Delete "the"; |
| Col. 1, line 59 | Delete "reinforce" and insert --reinforced--; |
| Col. 1, line 61 | After "$g/m^2$" insert --,--; |
| Col. 3, line 16 | Delete "in com-" and insert --incom--; |
| Col. 3, line 44 | Delete "door" and insert --or--; |
| Col. 3, line 60 | Delete "slabe" and insert --slab--; |
| Col. 3, line 65 | Delete "faced" and insert --face--; |
| Col. 4, line 46, Claim 1 | Delete "means" and insert --mass--; |

UNITED STATES PATENT AND TRADEMARK OFFICE

CERTIFICATE OF CORRECTION

PATENT NO. : 5,130,186

DATED : July 14, 1992

INVENTOR(S) : Jean-Jacques Pourtau
Thierry E. Pourtau

It is certified that error appears in the above-indentified patent and that said Letters Patent is hereby corrected as shown below:

Col. 6, line 3, claim 14, delete "70" and insert --700--

Signed and Sealed this

Eighth Day of February, 1994

Bruce Lehman

*Attest:*

BRUCE LEHMAN

*Attesting Officer*

*Commissioner of Patents and Trademarks*